US008621680B2

(12) United States Patent
Maes

(10) Patent No.: US 8,621,680 B2
(45) Date of Patent: Jan. 7, 2014

(54) HANGING SHOWER CURTAIN SUPPORT

(76) Inventor: Marietta Darlene Maes, Enterprise, MS (US)

( * ) Notice: Subject to any disclaimer, the term of this patent is extended or adjusted under 35 U.S.C. 154(b) by 266 days.

(21) Appl. No.: 12/952,194

(22) Filed: Nov. 22, 2010

(65) Prior Publication Data

US 2011/0145987 A1 Jun. 23, 2011

Related U.S. Application Data

(60) Provisional application No. 61/287,746, filed on Dec. 18, 2009.

(51) Int. Cl.
*A47K 3/00* (2006.01)

(52) U.S. Cl.
USPC ..... 4/610

(58) Field of Classification Search
USPC ..... 4/596, 607–610
See application file for complete search history.

(56) References Cited

U.S. PATENT DOCUMENTS

| | | | | |
|---|---|---|---|---|
| 2,188,163 | A * | 1/1940 | Sherman | 160/327 |
| 2,219,075 | A * | 10/1940 | Le Veau | 4/610 |
| 2,240,407 | A * | 4/1941 | Masters | 482/143 |
| 3,613,127 | A * | 10/1971 | Bond | 4/596 |
| 3,766,572 | A * | 10/1973 | Wright | 4/610 |
| 4,068,345 | A * | 1/1978 | Hehl et al. | 16/94 D |
| 4,158,896 | A | 6/1979 | Farkas | |
| 4,229,842 | A * | 10/1980 | Gilmore | 4/610 |
| 6,067,672 | A | 5/2000 | Klotz | |
| 7,024,706 | B2 | 4/2006 | Hess | |
| 2006/0278347 | A1 | 12/2006 | Jonson | |
| 2009/0119830 | A1 | 5/2009 | Goskowski et al. | |
| 2009/0173458 | A1 | 7/2009 | Roberts et al. | |
| 2010/0212845 | A1 | 8/2010 | Graneto, III et al. | |

FOREIGN PATENT DOCUMENTS

| | | | |
|---|---|---|---|
| DE | 003429819 | A1 | 2/1986 |
| DE | 20204922 | U1 | 7/2002 |
| FR | 2377789 | A | 9/1978 |
| JP | 407289417 | A | 11/1995 |
| JP | 02005168682 | A | 6/2005 |

* cited by examiner

*Primary Examiner* — Lori Baker
(74) *Attorney, Agent, or Firm* — Thien Tran, Esq; Access Patent Group, LLC

(57) ABSTRACT

A hanging shower curtain support for a bathtub/shower within a bathroom having a ceiling, walls and floor, includes a plurality of hooks that are secured into the ceiling above the bathtub/shower. A plurality of chains is provided, with each chain having a bottom retainer ring hanging downwardly from each hook. A shower curtain rod is suspended from the bottom retainer rings of the chains. The shower curtain rod will hold a shower curtain therefrom, to prevent water from splashing onto the walls and the floor of the bathroom.

10 Claims, 4 Drawing Sheets

HANGING SHOWER CURTAIN SUPPORT

CROSS-REFERENCE TO RELATED APPLICATION

This application claims the benefit of Provisional Patent Application No. 61/287,746, filed on Dec. 18, 2009, in the United States Patent & Trademark Office, the disclosure of which is incorporated herein by reference.

BACKGROUND OF THE INVENTION

1. Field of the Invention

The present invention relates to a shower curtain hanger, and more particularly, a hanging shower curtain support.

The hanging shower curtain support is a device that is suspended from the ceiling of a bathroom by hooks, chains and a shower curtain rod. The present invention provides a user with an attractive alternative to a standard wall-mounted shower curtain rod. The hooks are easily installed into the bathroom ceiling above a bathtub or shower. The user can hang any shower curtain on the shower curtain rod to prevent water from splashing onto the floor and walls of the bathroom, thereby preventing water damage and mildew. The hanging shower curtain support can also be used to provide privacy around a freestanding bathtub. Any homeowner or renter could appreciate this new approach to bathroom décor.

2. Description of the Prior Art

It is necessary for a homeowner or renter to hang a shower curtain around a bathtub or shower to prevent water from spraying the walls and floor of the bathroom. Otherwise, water damage and mildew problems can occur. A standard shower curtain rod is typically installed into the surrounding walls either through mounts or brackets or through the use of a tension rod. If a user has a free standing bathtub, they may be unable to use the standard installation methods. A user of a regular bathtub or shower may also prefer the aesthetics and conveniences that are provided by a suspended shower curtain rod. However, current options for a suspended shower curtain rod are limited, tend to be generally unattractive and require the user to install wall brackets. A better way is needed.

Numerous innovations for shower curtain holders have been provided in the prior art that will be described. Even though these innovations may be suitable for the specific individual purposes to which they address, however, they differ from the present invention.

A FIRST EXAMPLE, U.S. Pat. No. 2,188,163, issued on Jan. 23, 1940, to Sherman teaches in a shower-bath curtain installation, a curtain rod, means for preventing displacement of the curtain from its operative position when stretched into the position, the means comprising a plurality of upright rods, each terminating at its upper end in a curtain-rod-engaging portion slidably mounted on the curtain rod, means for detachably securing the upright rods to the curtain, a clamp on the curtain rod for each of the upright rods, a reduced part on each of the upright rods adjacent the curtain-rod-engaging portion, and rod holders on the clamp having side openings therein and having an inner diameter substantially equal to the unreduced portion of the curtain-rod-engaging portion, the curtain-rod-engaging portion preventing all movement of the rod except upward and disengaging movement thereof when the reduced portion of an upright rod is passed through the side opening of a holder and then moved downward to arrange the unreduced part of the rod in the holder.

A SECOND EXAMPLE, U.S. Pat. No. 2,219,075, issued on Oct. 22, 1940, to Le Veau teaches a quickly demountable support for sliding shower bath curtains, comprising a curtain rod of U-shape in plan providing an intermediate portion of a length substantially equal to the length of the shower bath tub and long end portions extending at right angles to the intermediate portion and of a length substantially equal to the width of the tub for supporting the curtains in surrounding relation to the ends and outer side of the tub, means to detachably mount the rod including brackets adapted to be secured to a vertical wall, detachable connections between the brackets and the ends of the rod, and vertical elongated suspension means for the intermediate portion of the rod having means to attach the upper end of the same to a ceiling and means to detachably engage the curtain rod at the lower end there.

A THIRD EXAMPLE, U.S. Pat. No. 3,766,572, issued on Oct. 23, 1973, to Wright teaches a shower curtain support for a bathtub-shower installation including a bathtub within a space having wall surfaces at the ends of the tub, a ceiling surface over the tub, and an open side along one side of the tub. The curtain support has a curtain rod with curved in turned ends and mounting bracket means for mounting the rod in position across the open side of the space with the inturned ends of the rod spaced from the wall surfaces to permit shower curtain hooks to slide along the rod from end to end and along its inturned ends for locating the ends of the shower curtain in close confronting relation to the wall surfaces.

A FOURTH EXAMPLE, U.S. Pat. No. 4,068,345, issued on Jan. 17, 1978, to Hehl et al. teach a curtain rod assembly for a shower curtain which comprises at least two rail sections of identical profile and each formed with an upwardly open longitudinally extending channel, a downwardly open longitudinally extending channel, and between these channels with an upwardly, downwardly, and laterally closed longitudinally extending passage. A coupling element has one half snugly longitudinally engaged in one of the ends of one of the passages and another half snugly longitudinally engaged in one of the ends of the other of the passages so as longitudinally to join these two sections. A plurality of shower-curtain hooks can slide along the downwardly open channel and a ceiling unit has a headpiece slidable along the upwardly open channel and an upwardly extending rod that is secured to the ceiling. Two wall mounting members are each secured to a wall and have a portion engaged snugly longitudinally in the other end of the passage of a respective rail. A valance strip of bendable material is engaged over the entire front side of both of the sections with its bent-over upper lip engaging over the upper edges of the rail sections and its bent-under lower lip engaging under the lower edges of these rails so as completely to cover them.

A FIFTH EXAMPLE, U.S. Pat. No. 4,158,896, issued on Jun. 26, 1979, to Farkas teaches a rectangular frame of shower curtain bars with shower curtains for a bathtub in a room away from or adjacent one or more walls. This rectangular frame comprises two longer conformable horizontal bars above the longer sides of the bathtub at about the height of the showerhead, which longer bars are fastened at their ends to two parallel vertical support means, such as walls and/or posts, beyond the opposite ends of the bathtub; and two parallel shorter telescopic horizontal bars above the ends of the bathtub and attached between the two longer parallel bars. At least the ends of the two shorter parallel bars have reduced cross-sections and are resiliently urged into facing holes in the facing sides of the longer bars. At least the longer bars or the posts, or both, are telescopic with drilled radial aligned holes through their telescoping sections for insertion of the ends of reduced cross-section of the orthogonal telescoping bars for seating and supporting these orthogonal bars, as well as for locking the seating bars and/or posts into their fixed length positions. The vertical supporting means include flanged sockets for the ends of the longer bars and/or for the ends of the vertical telescopic posts, which flanged sockets are anchored, such as by screws, to the walls, and/or floor and ceiling. Curtain means of horizontal bars are hung on the rectangular frame to completely surround the inside edges of the bathtub with adjacent vertical edges of the curtains overlapping each other.

A SIXTH EXAMPLE, U.S. Pat. No. 6,067,672, issued on May 30, 2000, to Klotz teaches a closure assembly for semi-permanent securement of an edge of the curtain to a wall of a shower enclosure. The closure assembly includes a clamping structure which comprises a mounting bar for permanent securement to a wall of a shower enclosure. The mounting bar includes a wall attachment surface for attachment to a wall of a shower enclosure and a first clamping surface. The mounting bar further includes a plurality of first fastener receiving holes. An adjustable clamp (is supported on the mounting bar) includes a second clamping surface which is disposed adjacent to the first clamping surface. The adjustable clamp includes a plurality of second fastener receiving holes. The first fastener receiving holes of the mounting bar are aligned with the second fastener receiving holes of the adjustable clamp. A plurality of threaded fasteners are disposed such that a threaded fastener engages each of the aligned first and second holes for securing the adjustable clamp to the mounting bar. A first curtain edge is disposed between the first and second clamping surfaces. The fasteners may be selectively tightened from a first position where the adjustable clamp is loosely secured to the first clamping surface such that the first curtain edge may be easily disposed between the first and second clamping surfaces, to a second water proof position where the fastener is under tension and applies a compressive clamping force on the first and second clamping surfaces as well as the intervening first curtain edge. The compressive clamping force applied to the first curtain edge by the fastener in the second position exceeds the shear strength of the curtain such that a force which exceeds the shear strength of the curtain applied to the curtain first edge will result in the tearing of the curtain before the release of the edge of the curtain from the position between the first and second clamping surfaces.

A SEVENTH EXAMPLE, U.S. Pat. No. 7,024,706, issued on Apr. 11, 2006, to Hess teaches shower curtain rod and holding devices for a shower area to be covered on a plurality of sides by an associated shower curtain to prevent shower water from escaping. The shower curtain rod is non-linear and is mounted at distal ends to walls of the shower area at least one-third of a total shower depth from a front of the shower. The holding devices have mounting portions that can be attached to walls in a variety of ways. A method of preventing water from escaping from the shower implements the rod and holding devices. A method of installing the rod and holding devices is easy and requires few steps.

AN EIGHTH EXAMPLE, U.S. Patent Office Publication No. 2006/0278347, published on Dec. 14, 2006, to Jonson teaches an arrangement for screening-off a space and for preventing liquid from splashing outside the space, comprising a plurality of lamellae or slats displaceable via an operating element and having a first longitudinal side and a second longitudinal side, the slats being displaceable between a first position screening-off the space and an open, second position. The first longitudinal side of the slats is free and the slats are supported by at least one ladder disposed at the second longitudinal side, the slats being vertically displaceable via the operating element between the first position screening-off the space and the open, second position, and the slats being pivotal about an axis running along the second longitudinal side and being substantially horizontal. The slats are distributed along the ladder with a mutual spacing so that the first longitudinal side of each respective slat, in the screening-off first position, projects over the second longitudinal side of an adjacent slat.

A NINTH EXAMPLE, U.S. Patent Office Publication No. 2009/0119830, published on May 14, 2009, to Goskowski et al. teach a shower curtain and support system employs an elongated rail supported at the shower or tub. The rail extrusion can be an extrusion with an inverted U profile, with an open slot or slots at its base. There are glides, e.g., nylon members with a ball, hemisphere, or other wide head portion and shaft that projects out through the slot from the open interior of the rail. The glides have one or two hook structures for attaching to a fabric curtain and a vinyl curtain liner. In one preferred version, there is a liner hook and spring retaining arm on one side that fits into the grommet at the top of the liner. On the other side is a short arm with a button that fits into a button hole on the cloth or fabric curtain. The curtain has blind button holes or grommets at its upper hem, so that the hook structure, e.g., button, does not show.

A TENTH EXAMPLE, U.S. Patent Office Publication No. 2009/0173458, published on Jul. 9, 2009, to Roberts et al. teach disposable curtains, systems and methods to install a disposable curtain, and methods of manufacturing a disposable curtain. A disclosed system to install a disposable curtain includes: a washable mesh upper curtain; an installation bag structured to be suspended from an installer during installation; a disposable curtain located in the installation bag; and a plurality of connectors to removably suspend the disposable curtain from the upper curtain.

AN ELEVENTH EXAMPLE, U.S. Patent Office Publication No. 2010/0212845, published on Aug. 26, 2010, to Graneto III et al. teach a curtain system which includes a curtain having a plurality of rod engaging members attached thereto, a plurality of rods each having a first end, and a curtain release mechanism attached to each rod at the first end thereof. The rod engaging members each include a stem having a first end and a second end, the first end of the stem configured for engagement with the curtain release mechanism, and a keyway formed in the stem and proximate the first end of the stem.

It is apparent now that numerous innovations for shower curtain holders have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a hanging shower curtain support that avoids the disadvantages of the prior art.

ANOTHER OBJECT of the present invention is to provide a hanging shower curtain support that is simple and inexpensive to manufacture.

STILL ANOTHER OBJECT of the present invention is to provide a hanging shower curtain support that is simple to use.

BRIEFLY STATED, STILL YET ANOTHER OBJECT of the present invention is to provide a hanging shower curtain support for a bathtub/shower within a bathroom having a ceiling, walls and floor, comprises a plurality of hooks that are secured into the ceiling above the bathtub/shower. A plurality of chains is provided with each chain having a bottom retainer ring hanging downwardly from each hook. A shower curtain rod is suspended from the bottom retainer rings of the chains. The shower curtain rod will hold a shower curtain therefrom, to prevent water from splashing onto the walls and the floor of the bathroom.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
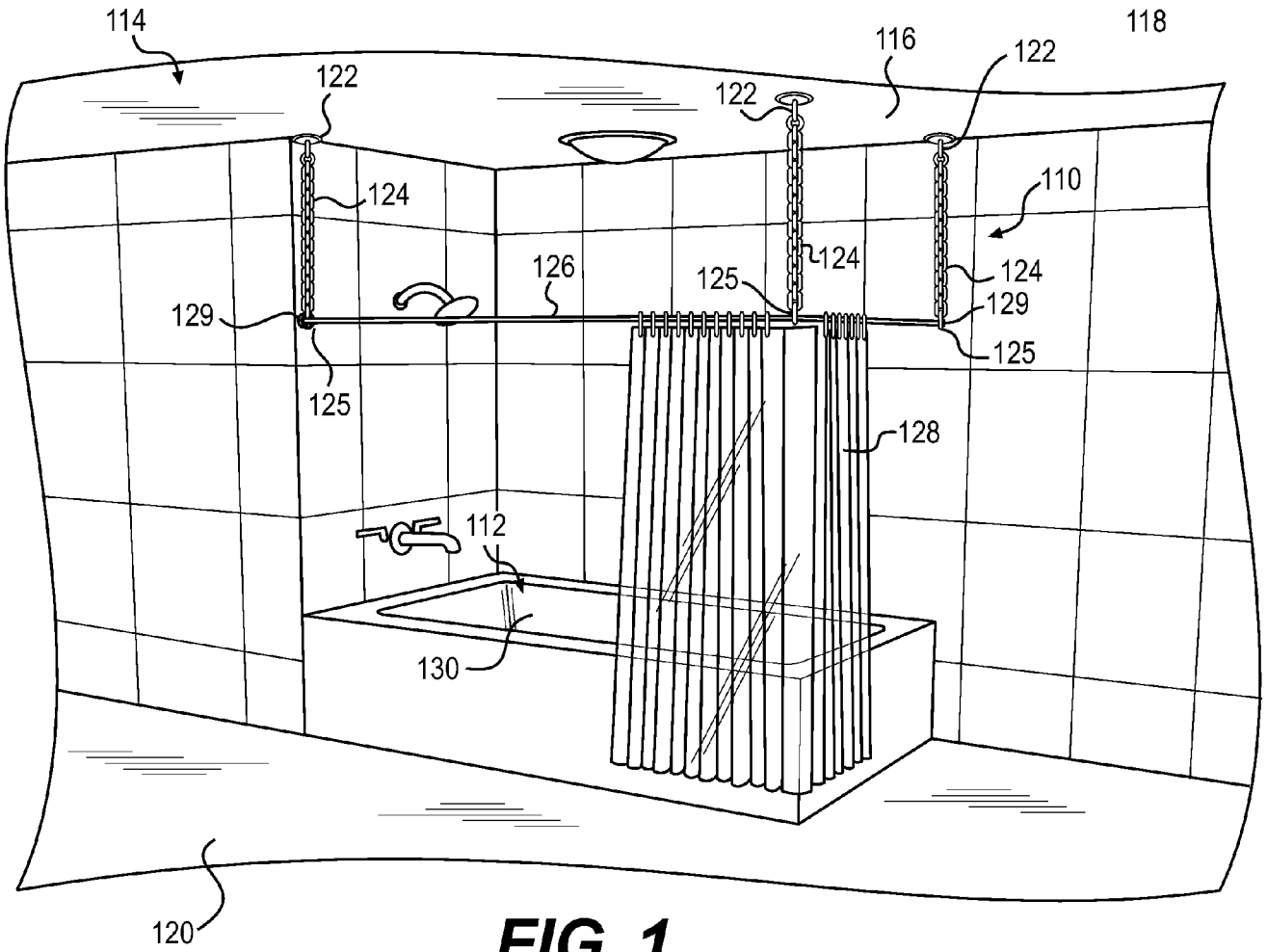
FIG. 1 is a perspective view showing the present invention being used for a corner bathtub in a bathroom.

110 hanging shower curtain support
112 bathtub/shower
114 bathroom
116 ceiling of bathroom 114
118 wall of bathroom 114
120 floor of bathroom 114
122 hook of support 110
124 chain of support 110
125 bottom retainer ring on chain 124
126 shower curtain rod of support 110
128 shower curtain
129 end cap of support 110
130 corner bathtub
132 freestanding bathtub
134 recessed bathtub

DETAILED DESCRIPTION OF THE PREFERRED EMBODIMENT

Referring now to the figures, in which like numerals indicate like parts, and particularly to FIGS. 1 through 4, and as such, will be discussed with reference thereto.

The present invention is a hanging shower curtain support 110 for a bathtub/shower 112 within a bathroom 114 having a ceiling 116, walls 118 and floor 120. The support 110 comprises a plurality of hooks 122 that are secured into the ceiling 116 above the bathtub/shower 112. A plurality of chains 124 are provided, with each chain 124 having a bottom retainer ring 125 hanging downwardly from each hook 112. A shower curtain rod 126 is suspended from the bottom retainer rings 125 of the chains 124. The shower curtain rod 126 will hold a shower curtain 128 therefrom, to prevent water from splashing onto the walls 118 and the floor 120 of the bathroom 114.

The hanging shower curtain support 110 further comprises a pair of end caps 129. The end caps 129 are placed onto the ends of the shower curtain rod 126 to protect the walls 118 of the bathroom 114 adjacent the bathtub/shower 112 from damage. The end caps 129 can be made out of soft plastic or rubber. The individual links of the chain 124 are approximately three quarters of an inch. The shower curtain rod 126 is approximately three quarters of an inch in diameter.

Figure 2:
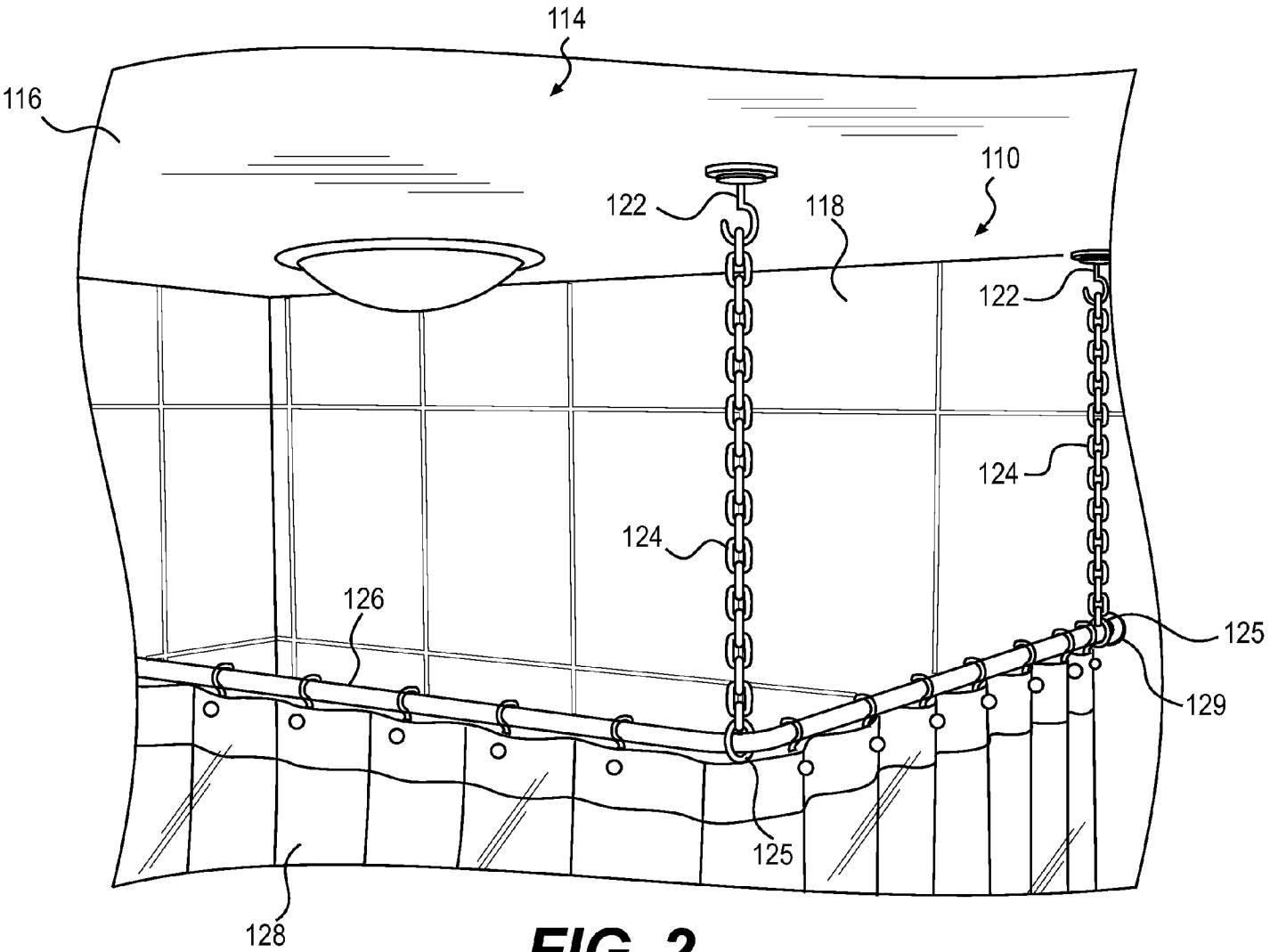
FIG. 2 is an enlarged perspective view of a portion of the present invention in FIG. 1.
Figure 3:
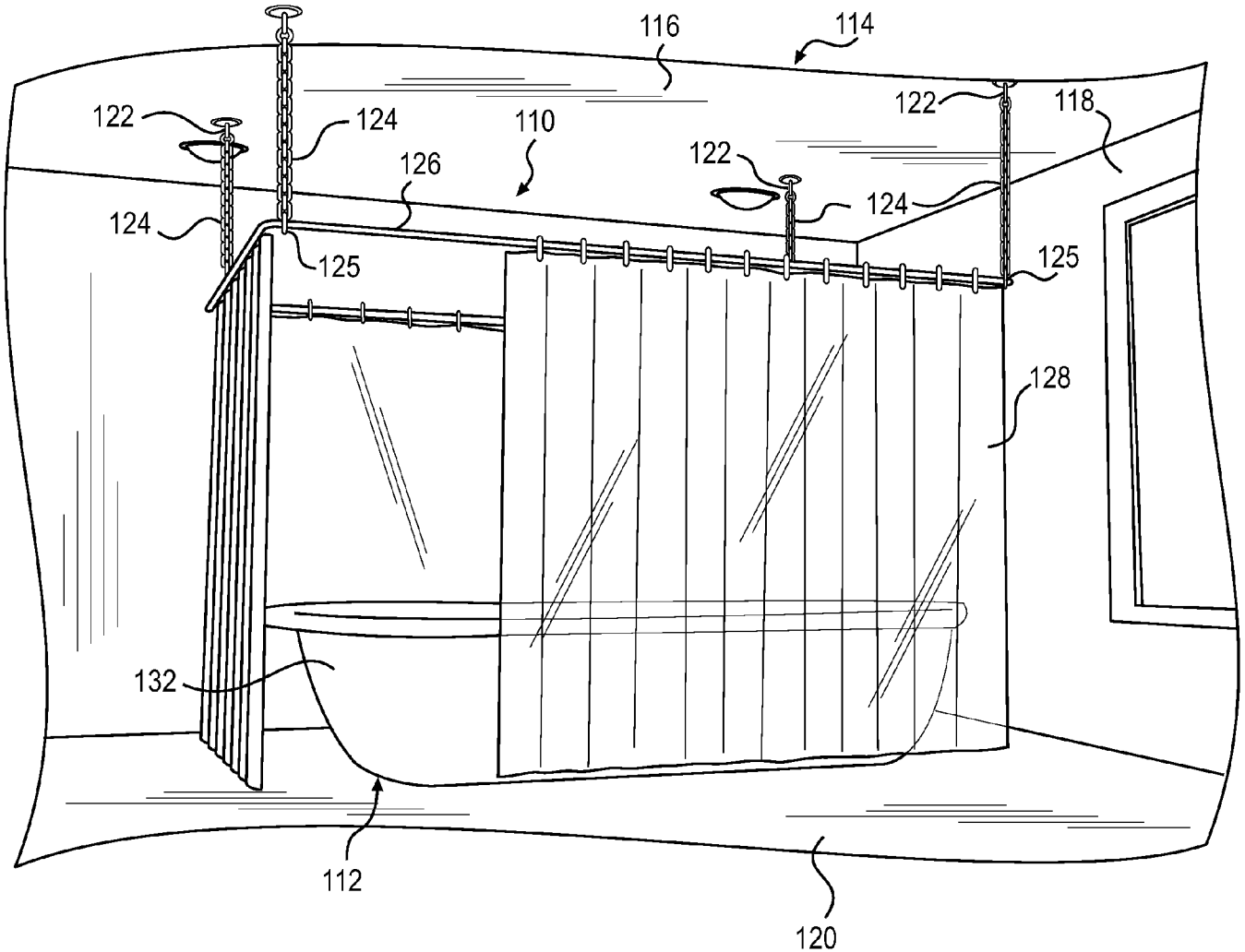
FIG. 3 is a perspective view showing the present invention being used for a free standing bathtub.
Figure 4:
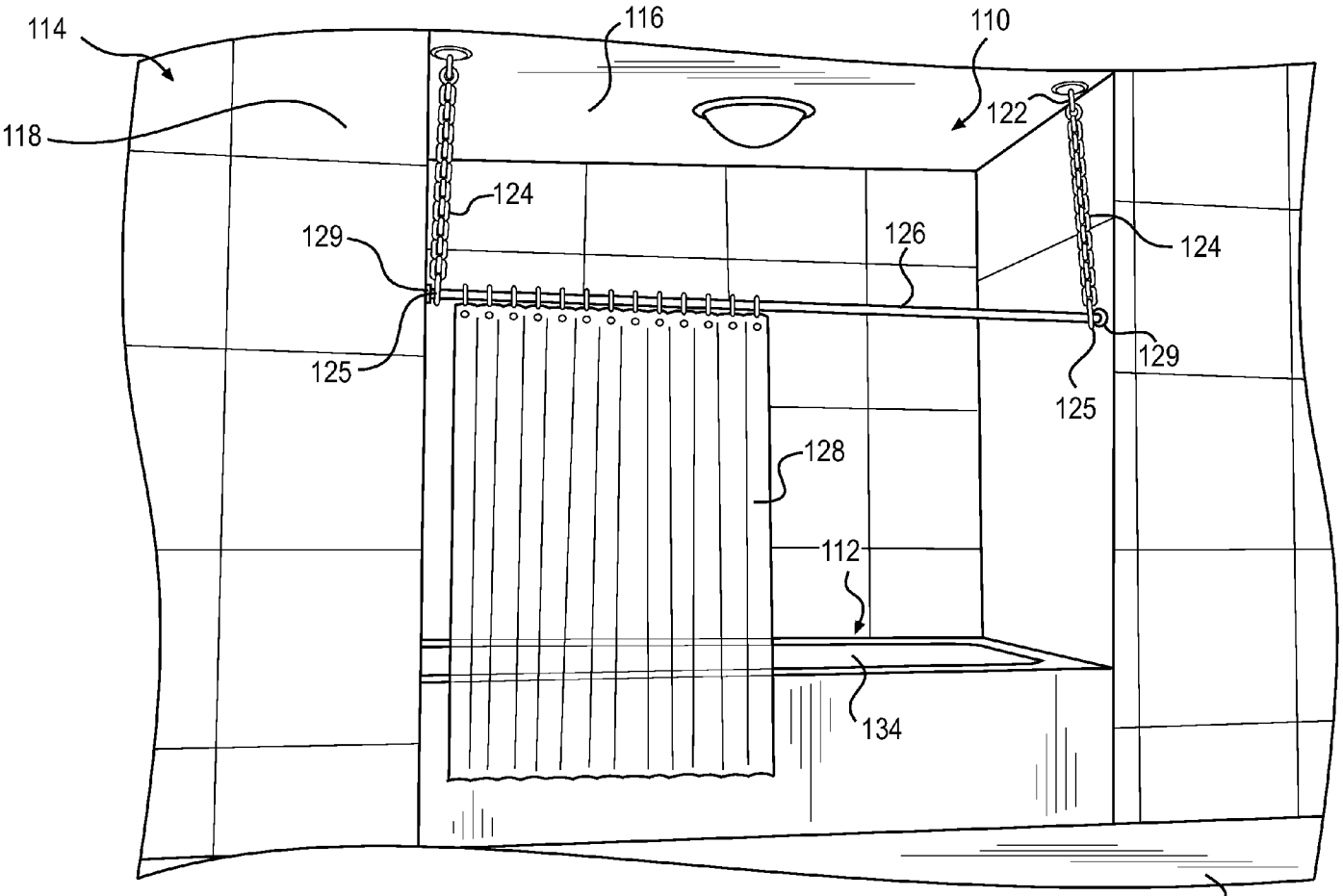
FIG. 4 is a perspective view showing the present invention being used for a bathtub recessed into a bathroom wall.

The shower curtain rod 126, as shown in FIG. 4, is approximately five feet in length. The shower curtain rod 126, as shown in FIGS. 1 and 2, is formed in an L-shaped configuration with a first leg being approximately five feet (05) in length and a second leg being approximately forty three (43) inches in length. The shower curtain rod 126, shown in FIG. 3, is formed in a rectangular shaped configuration with first and third longer legs being approximately five (05) feet in length, while second and fourth shorter legs being approximately forty three inches in length.

The hooks 122, the chains 124 and the shower curtain rod 126 are comprised out of non-corrosive materials, such as metal or plastic. The hooks 122, the chains 124 and the shower curtain rod 126 are comprised in a wide assortment of colors and styles to suit user references.

The hooks 122, the chains 124 and the shower curtain rod 126 are comprised in a variety of configurations to be used on many different sizes and shapes of the bathtub/shower 112 within the bathroom 114, such as a corner bathtub 130, shown in FIG. 1, a free standing bathtub 132, shown in FIG. 3 and a recessed bathtub 134, shown in FIG. 4.

In summary, the hanging shower curtain support 110 is a device that can be used by anyone to hang a shower curtain 128 over the bathtub/shower 112 to contain water in the bathroom 114 from splashing onto the walls 118 and the floor 120. The present invention consists of several hooks 122 that can be screwed or otherwise easily secured into the ceiling 116 above the bathtub/shower 112. The hooks 122 will hang the chains 124; so that the bottom retainer rings 125 will connect to and hold the shower curtain rod 126. The hanging shower curtain support 110 is comprised out of non-corrosive materials, such as metal or plastic and is available in a wide assortment of colors or styles to suit the user preferences. The components of the present invention can also be used on many different sizes and shapes of the bathtub/shower 112, such as the corner bathtub 130, the free standing bathtub 132 and the recessed bathtub 134. Exact specifications may vary upon manufacturing.

It will be understood that each of the elements described above, or two or more together, may also find a useful application in other types of constructions differing from the types described above.

While the invention has been illustrated and described as embodiments of a hanging shower curtain support, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hanging shower curtain support for a bathtub/shower within a bathroom having a ceiling, walls and floor, which comprises:

a) a plurality of hooks that are secured into the ceiling above the bathtub/shower;

b) a plurality of chains, each chain hangs down from each hook correspondingly, wherein each of the chains having a corresponding bottom retainer ring hangs downwardly from a bottom end of each chain; and c) a shower curtain rod suspended from the corresponding bottom retainer rings of each chains, whereby the shower curtain rod will hold a shower curtain therefrom, to prevent water from splashing onto the walls and the floor of the bathroom.

2. The hanging shower curtain support as recited in claim 1, further comprising a pair of end caps, wherein the end caps are placed onto the ends of the shower curtain rod to protect the walls of the bathroom adjacent the bathtub/shower from damage.

3. The hanging shower curtain support as recited in claim 1, wherein the individual links of the chain are approximately three quarters of a inch.

4. The hanging shower curtain support as recited in claim 1, wherein the shower curtain rod is approximately three quarters of an inch in diameter.

5. The hanging shower curtain support as recited in claim 4, wherein the shower curtain rod is approximately five feet in length.

6. The hanging shower curtain support as recited in claim 4, wherein the shower curtain rod is formed in an L-shaped configuration with a first leg being approximately five feet in length and a second leg being approximately forty three inches in length.

7. The shower curtain support as recited in claim 4, wherein the shower curtain rod is formed in a rectangular shaped configuration with first and third longer legs being approximately five feet in length, while second and fourth shorter legs being approximately forty three inches in length.

8. The hanging shower curtain support as recited in claim 1, wherein the hooks, the chains and the shower curtain rod are comprised out of non-corrosive materials.

9. The hanging shower curtain support as recited in claim 1, wherein the hooks, the chains and the shower curtain rod are comprised in a wide assortment of colors and styles to suit user preferences.

10. The hanging shower curtain support as recited in claim 1, wherein the hooks, the chains and the shower curtain rod are comprised in a variety of configurations to be used on many different sizes and shapes of the bathtub/shower within the bathroom.

* * * * *